United States Patent [19]

Acord

[11] 3,991,586

[45] Nov. 16, 1976

[54] SOLENOID CONTROLLED COLD HEAD FOR A CRYOGENIC COOLER

[75] Inventor: Timothy T. Acord, Alexandria, Va.

[73] Assignee: The United States of America as represented by the Secretary of the Army, Washington, D.C.

[22] Filed: Oct. 3, 1975

[21] Appl. No.: 619,155

[52] U.S. Cl. ..... 62/6; 60/520

[51] Int. Cl.[2] ..... F25B 9/00

[58] Field of Search ..... 62/6; 60/517, 520

[56] References Cited

UNITED STATES PATENTS 3,220,201 11/1965 Heuchling et al. ..... 62/6

3,765,187 10/1973 Horn ..... 62/6

*Primary Examiner*—William F. O'Dea
*Assistant Examiner*—Ronald C. Capossela
*Attorney, Agent, or Firm*—Nathan Edelberg; Max L. Harwell; Robert P. Gibson

[57] ABSTRACT

A solenoid control means for controlling the movement of a regenerator-displacer in a cryogenic cooler. The control means comprises sensing and power switching means for activating solenoids that assist in moving or restraining the movement of the regenerator-displacer in synchronism with pressure waves from a compressor.

7 Claims, 6 Drawing Figures

SOLENOID CONTROLLED COLD HEAD FOR A CRYOGENIC COOLER

The invention described herein may be manufactured, used, and licensed by or for the Government for governmental purposes without the payment to me of any royalty thereon.

BACKGROUND OF THE INVENTION

In cryogenic coolers of the type which has a compressor pressure wave driven free displacer, or regenerator-displacer, friction seals are generally used between the moving free displacer and the housing. When the friction seals are new, the movement of the free displacer occurs at or near the extremities of the pressure waves providing maximum work and thus maximum refrigeration. However, as the friction seals wear, there is less frictional restraint exerted by the seals and the free displacer will move even when very little force is applied by the pressure valves. Therefore, movement of the free displacer occurs prior to the pressure wave extremes, and thus less work and less refrigeration is done within the cooler.

SUMMARY OF THE INVENTION

The present invention comprises a solenoid controlled free displacer used in a closed cycle cryogenic cooler. In the present embodiments the cooler is remote to the compressor that drives the free displacer. The compressor provides pressure waves to the enclosed system of light gas by way of a feed line. Also, friction seals are replaced by clearance seals since in the present embodiments, proper operation of the cooler does not depend on friction from the seals. Solenoid operation is synchronized with the pressure waves from the to move the free displacer in such a manner as to provide maximum work. Even though the clearance seals do not form a tight frictional fit, they are of the proper size to prevent excessive leakage between the housing and regenerator-displacer.

The present invention comprises, as one embodiment, a solenoid for pulling the free displacer in one direction and a spring return for biasing the free displacer in the other direction. Another embodiment has two solenoids either mounted back-to-back or front-to-front in which the two solenoids may be used to selectively drive or to selectively brake the regenerator-displacer. The solenoids may be switched "off" and "on" by suitable means. These means may include, but are not limited to, a pressure transducer connected in the pressure feed line between the compressor and cooler or an encoder pickup circuit sensing the instantaneous position of the shaft of a motor that is driving the compressor. Outputs from either the pressure transducer or encoder pickup circuit may be applied to signal conditioning circuits and power switching circuits for providing sufficient current to the solenoid coils to either drive or brake the regenerator-displacer. Since either the pressure transducer or the drive shaft position indicate the exact phase of the pressure wave, the pressure wave and the solenoid operation are synchronized to act simultaneously on the free displacer whether the solenoid operation is in the driving or braking modes.

DETAILED DESCRIPTION OF THE PREFERRED EMBODIMENT

Figure 1:
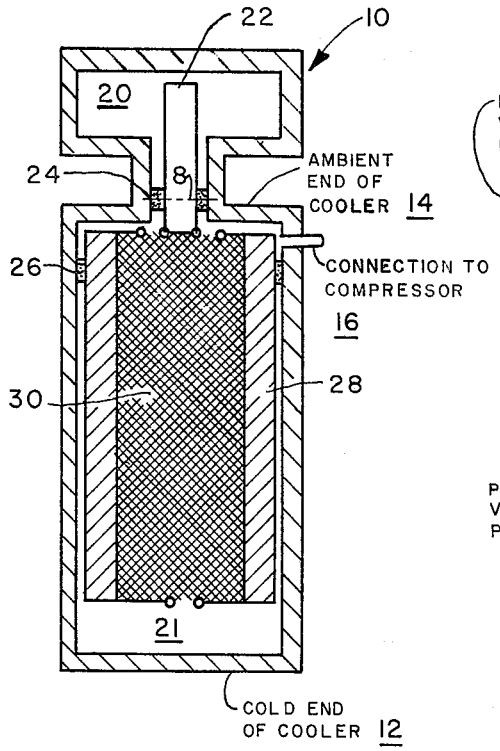
FIG. 1 shows a typical prior art split cycle cryogenic refrigerator using input pressure waves from a compressor as the only moving force.

A known split-cycle cryogenic refrigerator, or cooler, will now be described with reference to FIGS. 1, 2, and 3. Cooler 10 has a cold end 12 and an ambient temperature end 14 and a regenerator-displacer 28 having a pneumatic piston 22 connected thereto at one end and extending into an enclosed pneumatic volume 20 at the ambient end of cooler 10. A cold volume 21 exists at cold end 12 and is the enclosed area where refrigeration takes place. A remote compressor (not shown) provides pressure waves of the light gas enclosed between the compressor and cooler 10. The pressure waves enter at inlet connection 16. A relatively constant pressure, which is approximately the average pressure of the input pressure wave, is maintained in volume 20. The input pressure waves are depicted as sinusoidal in FIGS. 2 and 3 but are not limited to that particular shape. The high pressure cycle of the wave causes gas flow through a regenerator matrix 30, within regenerator-displacer 28, toward cold volume 21. The regenerator matrix 30 is porous and therefore offers little resistance to the gas flow during either the high or low pressure waves. The high pressure cycle causes displacer 28 to move toward ambient end 14 if friction seals 24 and 26 are new and are maintaining a relatively tight seal between the regenerator-displacer and the housing. Displacer 28 moves because of the difference in forces across the effective pneumatic piston cross-sectional area 8. The effective cross sectional area 8 acted on by the force is greater if seal 24 is firmly attached to pneumatic piston 22 rather than the housing since additional effective cross-sectional area is provided by seal 24 itself. When the pressure wave is at or near the minimum pressure during a cycle, the pressure from the compressed gas in pneumatic volume 20 is greater than the instantaneous input pressure and a differential force across the effective pneumatic piston cross-sectional area 8 toward the cold end 12 results. The differential pressures overcome the friction provided by seals 24 and 26 and move displacer 28 back to the cold end 12. It should be noted that even though the light gas operates in a closed system that some gas leaks by the seals but the amount is very minimal and does not hinder refrigeration. Regenerator matrix 30 may be made of nickel-alloy spheres held inside regenerator-displacer 28 by porous plugs or screen mesh wires at each end of 28.

Figure 2:
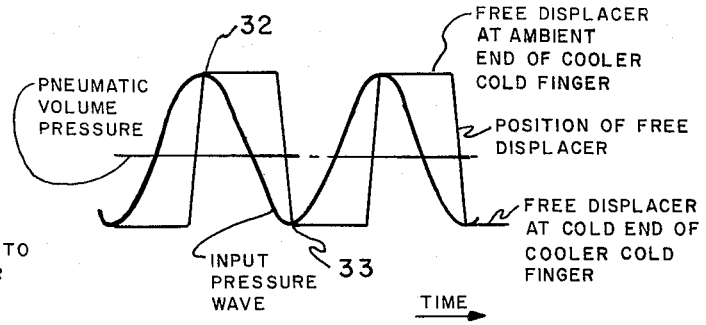
FIG. 2 illustrates curves describing the relative position of the refrigerator free dispalcer in relation to the input pressure waves when the friction seals are new.
Figure 3:
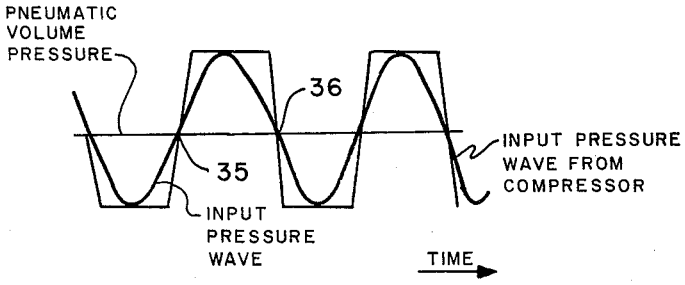
FIG. 3 represents the same curves as FIG. 2 but when the friction seals are worn.

Displacer 28 moves from ambient end to cold end reciprocally as depicted by the generally square shaped waves of FIGS. 2 and 3. FIG. 2 shows the movement of the free displacer relative to the sinusoidal pressure waves when seals 24 and 26 are new. That is, displacer 28 does not move until the input pressure wave is near its peak pressure point 32 or near its lowest pressure point 33. The operation of the free-displacer in accordance with the pressure waves as shown in FIG. 2 are the in-phase operation discussed throughout this application. FIG. 3 shows movement of the free displacer relative to the pressure waves when the seals 24 and 26 are worn and their frictional forces on the walls of the cooler 10 housing are not maintained. When seals 24 and 26 are worn, displacer 28 starts to move immediately when even a slight force in the proper direction is produced by a pressure difference across the effective pneumatic piston cross-sectional area 8 of pneumatic piston 22. The amplitudes and widths of the sine waves represent the input pressure wave from the compressor and the generally square waves representing the position of the free-displacer are the same for the in-phase operation depicted by FIG. 2 and the out-of-phase operation shown by FIG. 3.

In FIG. 3, assume that the pressure wave is moving from left to right. The pneumatic volume pressure is shown along the centerline of the pressure wave and is indicative of the average pressure of the alternating pressure wave. When the instantaneously applied pressure passes this center line, represented at points 35 and 36, the free displacer moves immediately in the direction away from the larger applied force. More work and therefore more cooling of cold end 12, occurs when the seals are new and the movement of the displacer responds to the pressure wave as shown in FIG. 2. Since the pressure times volume is work and the amount of change of working volume 21 is relatively constant then to produce more work or more refrigeration, the instantaneous pressure must be increased at the time of displacer 28 movement to increase work.

Figure 4:
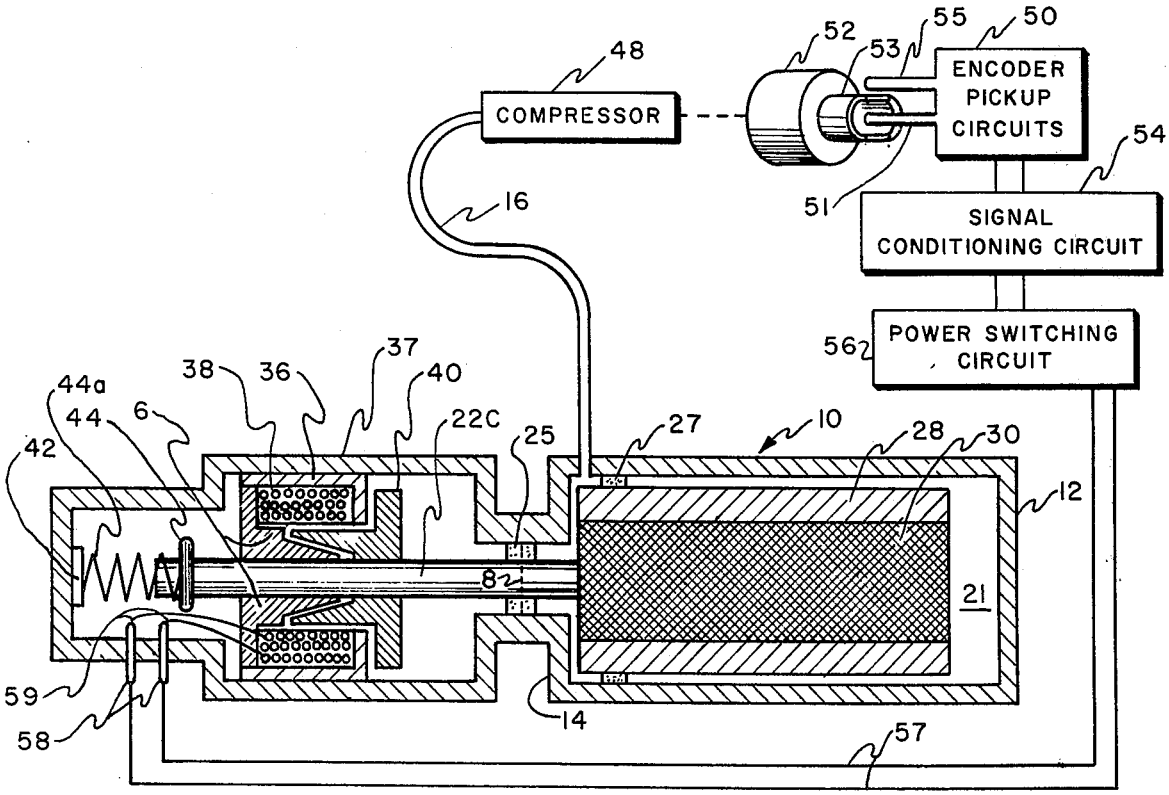
FIG. 4 illustrates the present embodiment of a unidirectional solenoid driven cold head and spring return.

The solenoid controlled movement of displacer 28, which is explained herein below with reference to FIGS. 4 and 5, avoids the cooling loss within cooler 10 caused by wear of the friction seals. In fact, in the preferred embodiments of this invention shown in both FIGS. 4 and 5, the friction seals 24 and 26 are replaced by clearance seals 25 and 27 respectively so that the undesirable wear of the seals is no longer a major factor because the clearance seals are not frictionally fit between the pneumatic pistons or displacer and the housing. FIG. 4 illustrates the position of regenerator-displacer 28 when coil 38 is activated.

Figure 5:
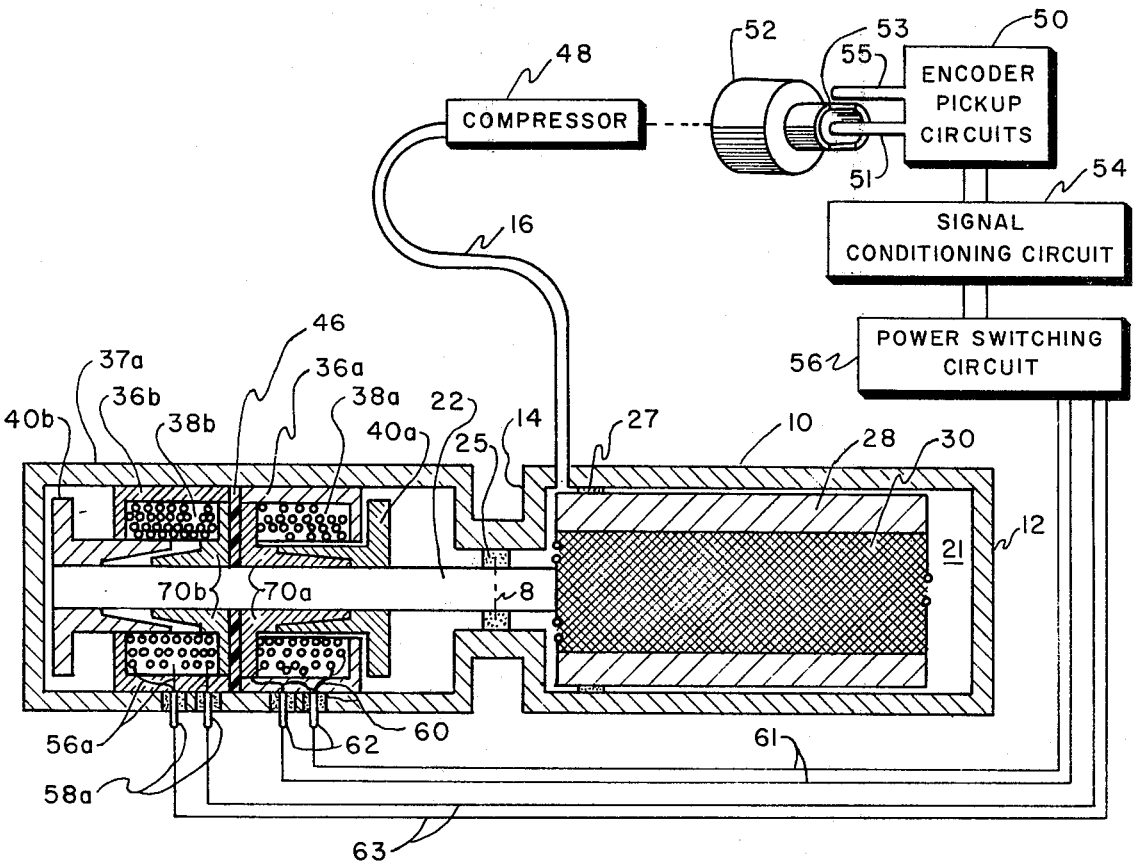
FIG. 5 illustrates another embodiment comprising two solenoids either driving or braking the regenerator-displacer movement in both directions.

Clearance seals 27 and 25 are used with the solenoid operated displacer 28 and pneumatic pistons 22*c* or 22*d* in FIGS. 4 and 5 respectively because clearance seals withstand a relatively strong pressure yet do not wear very easily. There will be some blow-by of the light gas past seals 25 and 27 but does not effect proper operation. Look now more closely at FIG. 4 for one embodiment of the present invention. Numerals in FIG. 4 for the cooler 10 are the same as those referenced in FIG. 1, with the exception that the operation of the average pressure in pneumatic volume 20 has been replaced by a solenoid and spring mechanism on a long pneumatic piston 22*c* enclosed within housing 37. The diameter and therefore the cross-sectional area, of piston 22*c* is minimized in the embodiment of FIG. 4 since the driving force is primarily supplied by the solenoid action in one direction and the spring in the other direction. The operation of the solenoid and spring are as follows. Spring 44*a* is biased between spring holder 42 at the pneumatic volume end and a spring retainer 44 that is bonded to piston 22*c*. Spring 44*a* keeps displacer 28 biased toward cold end 12.

However, when sufficient electrical current is supplied through solenoid coil 38, a magnetic flux produced by the flow of the electrical current through coil 38 acts on a pole piece of magnetic material 40 that is firmly attached to pneumatic piston 22*c*. Coil 38 is attached to housing 37 by an iron shell or case 36 to provide a magnetic flux path through a stationary pole piece 6 and moveable plunger or pole piece 40. That is, pole piece 6 is stationary with respect to coil 38 and case 36 but pole piece 40 is firmly attached to piston 22*c* and is moveable since piston 22*c* is firmly attached to free moving regenerator-displacer 28. Therefore, electrical current flow through coil 38 acts on moveable pole piece 40 causing the movement of pneumatic piston 22*c* and displacer 28 away from cold end 12 in a quick movement. Therefore, cyclical movement of the regenerator-displacer 28 depends on the cycle of sufficient electrical current through coil 38.

The solenoid-spring arrangement as discussed above may be reversed. That is, a spring may bias the regenerator-displacer 28 toward the ambient end and the outputs from circuit 56 may cause solenoid operation during the low pressure output phase from the compressor to move displacer 28 toward the cold end 12 in an in-phase operation. The current flow through coil 38 may be synchronized with the pressure pulses from compressor 48 by a variety of control means. One typical synchronizing means comprises a bread boarded encoder pickup circuit 50 having as an input a light emitting diode positioned on the inside and a light emitting diode detector on the outside of an encoder wheel 53 that is attached to the rotor of a compressor motor 52. The encoder wheel 53 comprises a tubular section having part of the tubular section cut out, for example one half cut-out. The light emitting diode is mounted on an extension 51 out from encoder pickup circuit 50, and the detector is mounted on another extension 55 out from circuit 50. For alternate 180° of rotation of the encoder wheel 53 a signal is produced by circuit 50 that is applied to a solenoid control means comprising a signal conditioning circuit 54 and a power switching circuit 56. The signal conditioning circuit 54 may be some logic circuit, time delay circuit, or the like, that provides interface between encoder 50 and the power switching circuit 56. The action of the encoder pickup circuit 50 is synchronized with the pressure waves from compressor 48 since the rotor of motor 52 is mechanically linked to and drives compressor 48. The signal conditioning circuit 54 can be thought of as controlling the switch of power switching circuit 56 for providing a solenoid control means. Current from circuit 56 is applied to coil 38 by way of leads 57, feedthroughs 58 and lead wires 59 when there is high pressure in line 16. Therefore, solenoid coil 38 provides magnetic flux that acts on moveable pole piece 40 to move 40 against stationary pole piece 6 and thus pull 28 to the ambient end 14 during each alternate high pressure half cycle of the compressor. Also spring 44*a* biases the regenerator-displacer 28 back to the cold end 12 when current is removed from coil 38 during each of the other alternate low pressure half cycles of the complete compressor cycle. With the driving action of the solenoid and spring controlling the reciprocal movement of the regenerator-displacer 28 instead of the actual differential pressures across the effective pneumatic piston cross-sectional area 8 controlling the movement, the previously used friction seals are not required and are therefore replaced by clearance seals 25 and 27.

Refer now to FIG. 5 wherein a two solenoid control means is shown within housing 37*a* of the cooler. In this particular embodiment the solenoid coils 38*a* 38*b* are connected back-to-back. Coil 38*a* is activated and coil 38*b* is inactivated. Therefore displacer 28 is pulled toward the ambient end. The numerical elements of the cold end 12 are the same as referenced in FIGS. 1 and 4. The pneumatic piston 22*d* has a diameter large enough to cause differential forces across the effective pneumatic piston cross-sectional area 8 sufficient to operate the regenerator-displacer in the driving mode. Piston 22*d* has two moveable pole pieces of magnetic material 40*a* and 40*b* fixed thereto that react to electrical currents flowing in solenoid coils 38*a* and 38*b* respectively. A A thin layer of insulation material 46 separates coils 38*a* and 38*b* so that magnetic flux does not interfere therebetween. Stationary pole pieces 70*a* and 70*b* are attached to coils 38*a* and 38*b* respectively. Also, iron shells 36*a* and 36*b* surround coils 38*a* respectively to provide magnetic flux paths for their respective solenoid coils. With the use of two solenoids as shown in FIG. 5, there is more versatility in controlling the movement of free displacer 28. Electrical voltage is connected to the two coils 38*a* and 38*b* from the power switching circuit 56 through leads 61 and 63 and feedthroughs 62 and 58*a* respectively by way of leadwires 60 and 56*a*.

One operation of the embodiment of FIG. 5 is as follows. The solenoid operation is explained as being in the driving mode. However, solenoid operation may be in the braking mode which also will be explained in this specification. Since coils 38*a* and 38*b* are connected back-to-back, power to coil 38*b* is switched off and power to coil 38*a* is switched on during the high pressure phase of the compression wave. Conversely, during the low pressure phase, coil 38*b* is switched on while coil 38*a* is switched off. With the switching provided in this manner, the pneumatic piston 22*d* moves the regenerator-displacer 28 away from the greater force across the effective cross-sectional area 8. Also, coils 38*a* and 38*b* may be connected front-to-front with the switching cycles reversed and accomplish the same in-phase operation of the solenoids with the pressure waves.

Figure 6:
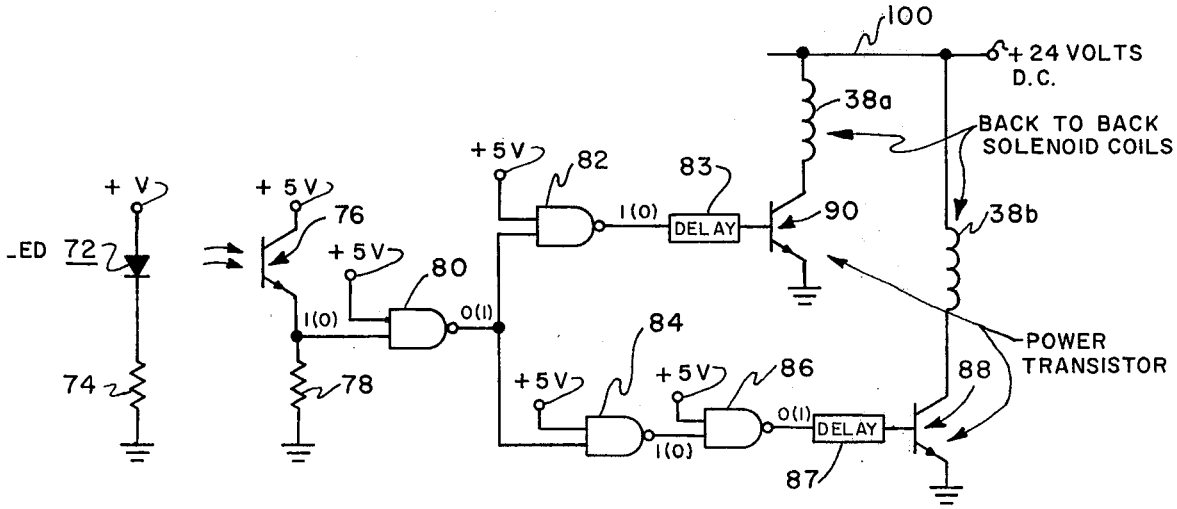
FIG. 6 is a schematic of the encoder pickup, signal conditioning and switching circuits of the embodiment of FIG. 5.

The electrical schematic of FIG. 6 shows a logic circuit used between the encoder pickup circuit 50 and coils 38*a* and 38*b* to control the current through the two solenoid coils 38*a* and 38*b*. This logic circuit comprises all the operations of circuits 50, 54, and 56. A light emitting diode 72, which is not necessarily of the visible spectrum, is shown connected in series with a direct current voltage source +V, and resistor 74 to ground. The light emitting diode (LED) 72 is placed on extension 51 that extends inside the encoder wheel 53. Assume that encoder wheel 53 has a cut-out section over half the tubular section. Light sensitive transistor 76 is positioned on extension 55 such that for every half revolution of wheel 53 transistor 76 is turned on by light from the LED 72 causing transistor 76 to conduct.

The binary conditions of 1 or 0 are shown throughout FIG. 6 according to whether the encoder wheel 53 has the light passing or blocked between the LED 72 and transistor 76. The binary conditions are shown in positive logic outside parenthesis for the open and inside paranthesis for the blocked light conditions. At the output of transistor 76 are group of NAND gates 80, 82, 84, and 86 wired as inverters. The NAND gates provide the logic outputs to power transistors 88 and 90 for switching a positive 24 volts direct current voltage on buss 100 across solenoid coils 38*b* and 38*a* respectively. Blocks 83 and 87 are optional delay circuits used to delay the voltage from NAND gates 82 and 84 respectively. These optional delay circuits could be resistance-capacitance delay timers where the resistance is varied to select the desired time delay. Transistor 76 is connected in series with a +5 volts power supply and resistor 78 to ground. A typical value for resistor 78 is 1 kilo-ohm.

NAND gate 82 reinverts the output from NAND gate 80 back to logic 1 (0) as an input through delay circuit 83 to the base of power transistor 90. Since transistor 90 is an n-p-n transistor the positive logic 1 state switches the power transistor 90 on. During the time transistor 90 is off essentially no current flows through solenoid coil 38*a*. However, with binary state positive logic 1 present on the base of transistor 90 solenoid coil 38*a* will conduct heavily since coil 38*a* is essentially connected between a positive 24 volts direct current voltage source along buss 100 and directly to ground since transistor 90 offers very little resistance in the conducting state.

Simultaneously, with the conducting half cycle of transistor 90 transistor 88 is cut off and thus solenoid coil 38*b* is not conducting current therethrough. An additional inverter NAND gate 86 is connected in series with NAND gate 84 to provide a positive logic 0 at the base of n-p-n transistor 88 at the same time the positive logic 1 is present at the base of transistor 90. With the signal conditioning circuit, comprising NAND gates 80, 82, 84 and 86 and referred to above in FIGS. 4 and 5 as block 54, connected in this manner between the encoder pickup and power switching transistors 88 and 90, solenoid coils 38*b* and 38*a* are on at different times and therefore do not interfere in the operation of each other.

The solenoid action may also be partially out-of-phase with the pressure wave when coils 38*a* and 38*b* are connected back-to-back and be used as a temporary brake for the regenerator-displacer. The purpose of braking is to change from a pressure wave out-of-phase condition to an in-phase condition. Operation in this manner requires that the size of the effective pneumatic piston cross-sectional area 8, which is the area where differential pressure forces act, be increased to sufficient size for producing the actual force needed to move the regenerator-displacer at the early portion of the pressure wave which initiates the moving force.

When the regenerator-displacer 28 reaches the ambient end 14, electrical current to solenoid coil 38*a* may be switched on by proper phasing of encoder pickup circuit 50, signal conditioning circuit 54, and power switching circuit 56 to hold the regenerator-displacer 28 stationary until the differential forces across the effective pneumatic piston cross-sectional area 8 builds up to a value such that when released by the braking, solenoid action would provide maximum work and maximum net refrigeration. Look back at FIG. 2, which shows the only true in-phase operation, to see the point where the regenerator-displacer 28 is released by the braking solenoid to provide maximum refrigeration. The regenerator-displacer 28 is released at or near points 32 and 33 on the pressure wave. That is, the regenerator-displacer 28 is held by braking action from the time the pressure wave passes the pneumatic volume pressure line either going higher to point 32 or lower to point 33 and is then released at points 32 and 33 to cause the in-phase operation that provides maximum refrigeration.

In view of the above explanation, the activated solenoid coil 38*a* holds the regenerator-displacer 28 at the ambient end 14, as shown in FIG. 5, until the pressure wave goes below the pneumatic volume pressure to or near the lowest pressure point 33 and current through solenoid coil 38*a* is released. Thus, 28 then moves in a quick motion back to the cold end 12. Conversely, 28 is held at the cold end by current flow through coil 38*b* during the time that the pressure wave builds up from the pneumatic volume pressure to at or near the highest pressure point 32 and current through coil 38*b* is released allowing regenerator-displacer 28 to move back to the ambient end in a quick motion.

There are many advantages to using the solenoid in a braking mode rather than a driving mode. First, in the driving mode it takes much more electrical current to produce the required magnetic flux to interact with magnetic slugs for driving the regenerator-displacer 28. However, in using the solenoids as a brake for holding the regenerator-displacer 28 after it has been originally moved by the pressure wave, the amount of electrical current required can be greatly reduced. That is, there is less current required to hold 38 due to the reduced magnetic reluctance than there is to originally pull moveable pole pieces 40*a* and 40*b* into the area within the solenoid coils. Second, the cooler is not dependent on seal friction and is not effected by the undesirable changes that occur in frictional force due to wearing of the seals. Therefore, clearance seals may be used. Another important advantage with using clearance seals is that cooler operation is more reliable due to less temperature dependence of the seals since the relative coefficients of linear expansion of the seals 25 and 27 when compared to the cooler walls and the regenerator-displacer 28 and the pneumatic piston are less critical.

One switching variation for the embodiment of FIG. 5 is that in which the effective pneumatic piston cross-sectional area 8 is of sufficient size whereby the extreme pressure pulses provide just enough force to overcome the static friction restraining the displacer 28. With this particular size, once the displacer 28 starts moving, the forces developed across the pneumatic piston cross-sectional area 8 continues the movement of 28. However, one of the solenoids may be switched on for only a very short time to start movement of displacer 28. One means of providing a very short pulse to the solenoid coils is to have very narrow slits instead of half cut-outs in the encoder wheel 53 and alter the open and blocked time of light from LED 72 to transistor 76. Also, solid state timing devices may be used to adjust to the length of the pulses if a particular pulse length is desired. The advantage of using a short pulse is the reduction of total power required to drive solenoid coils 38*a* and 38*b*.

While many modifications may be obvious to one skilled in the art of the present invention, it is to be understood that I desire to be limited in the spirit of my invention only by the scope of the appended claims.

I claim:

1. A solenoid controlled cold head for a closed cycle cryogenic cooler comprising:

an enclosed cooler housing having a cold end and an ambient temperature end;

a free moving regenerator-displacer having a regenerator matrix therein positioned within said cold end and having a pneumatic piston rigidly attached to said regenerator-displacer at said ambient temperature end wherein said pneumatic piston extends into an average pressure pneumatic volume;

an effective pneumatic piston cross-sectional area on a portion of said pneumatic piston between said regenerator-displacer and said pneumatic volume that provides movement means for said free moving regenerator-displacer within said cooler housing when differential pressures are applied thereacross;

a compressor and compressor driving means mechanically linked together for providing alternating pressure waves of a light gas enclosed within said closed cycle and in communication with said regenerator-displacer for cyclically applying differential pressures across said effective pneumatic piston cross-sectional area to move said regenerator-displacer reciprocally within said cooler housing; and a control means comprising a synchronizing means sensing and reacting to the phase of said alternating pressure waves and solenoid control means responding to said synchronizing means for moving said pneumatic piston and said regenerator-displacer rigidly attached thereto when said alternating pressure waves are at their maximum and minimum for providing in-phase operation causing more work and more refrigeration at said cold end.

2. A solenoid controlled cold head as set forth in claim 1 wherein said regenerator matrix is a plurality of nickel-alloy spheres held within said regenerator-displacer by a porous retainer means at each end with said pneumatic piston connected to one end of said regenerator-displacer.

3. A solenoid controlled cold head as set forth in claim 2 wherein said compressor means is a remotely operated reciprocating compressor having a feed line through which said alternating pressure waves are transmitted to said cooler housing between said effective pneumatic piston cross-sectional area and said cold end.

4. A solenoid controlled cold head as set forth in claim 3 wherein said feed line is in communication with said cooler housing between said effective pneumatic piston cross-sectional area and the place where said pneumatic piston is connected to one of said porous retainer means in which said regenerator matrix and said porous retainer means allows said pressure waves of said light gas to pass therethrough relatively unimpeded.

5. A solenoid controlled cold head as set forth in claim 4 wherein said compressor driving means is an electric motor having a tubular encoder wheel with cut-outs therein connected to the drive shaft and extending outward from said motor and wherein said control means comprises:

a minimum size diameter pneumatic piston providing a minimum effective pneumatic piston cross-sectional area;

an encoder pickup circuit having pickup means associated with said tubular encoder wheel for detecting the position of the drive shaft of said compressor driving means to which said compressor is mechanically linked to provide a signal therefrom that is synchronized with said alternating pressure waves from said compressor;

a power switching circuit;

a signal conditioning circuit interfaced between said encoder pickup circuit and said power switching circuit for conditioning said signal from said encoder pickup circuit to said in-phase operation with said alternating pressure waves prior to applying the conditioned signal to said power switching circuit;

a solenoid coil having a stationary pole piece and magnetic flux path associated therewith surrounding a moveable magnetic material that is rigidly attached to a portion of said minimum size diameter pneumatic piston within said pneumatic volume wherein electrical current flow through said solenoid coil pulls said pneumatic piston and said regenerator-displacer attached thereto toward the ambient temperature; and a biasing spring positioned between the end housing of said pneumatic volume and the end of said pneumatic piston for biasing said regenerator-displacer toward the cold end when no current flows through said solenoid coil whereby solenoid coil action overcomes the bias of said biasing spring when said power switching circuit applied electrical current therethrough and whereby said minimum size diameter pneumatic piston has minimum effect on the movement of said regenerator-displacer leaving movement of said regenerator-displacer controlled by an in-phase operation with said alternating pressure waves by action of said biasing spring and said solenoid coil.

6. A solenoid controlled cold head as set forth in the preamble of claim 5 wherein said control means comprises:

an enlarged diameter pneumatic piston providing an effective pneumatic piston cross-sectional area sufficiently large enough to start movement of said regenerator-displacer when said differential pressure forces across said effective pneumatic piston cross-sectional area are present;

an encoder pickup circuit having pickup means associated with said tubular encoder wheel for detecting the position of the drive shaft of said compressor driving means to which said compressor is mechanically linked to provide a signal therefrom that is synchronized with said alternating pressure waves from said compressor;

a power switching circuit;

a signal conditioning circuit interfaced between said encoder pickup circuit and said power switching circuit for conditioning said signal from said encoder pickup circuit to said in-phase operation with said alternating pressure waves prior to applying the conditioned signal to said power switching circuit;

first and second solenoid coils having a stationary pole piece and magnetic flux path associated with each coil surrounding first and second moveable pole pieces of magnetic material that are rigidly attached to a portion of said enlarged diameter pneumatic piston within said pneumatic volume wherein said first and second solenoid coils are connected back-to-back in the driving mode for said free moving regenerator-displacer wherein electrical current flowing through said first solenoid coil reacts with said first moveable pole piece for pulling said enlarged diameter pneumatic piston and said regenerator-displacer attached thereto to said ambient temperature end during one half cycle of operation while no electrical current flows through said second solenoid coil and wherein during the other half cycle of operation electrical current flows through said second solenoid coil that reacts with said second moveable pole piece for pulling said enlarged diameter pneumatic piston and said regenerator-displacer to said cold end while no electrical current flows through said first solenoid coil such that said conditioned signal to said power switching circuit synchronizes the electrical current flow through said first and second solenoid coils for in-phase driving mode operation with the differential pressure forces on said effective pneumatic piston cross-sectional area.

7. A solenoid controlled cold head as set forth in claim 6 wherein said first and second solenoid coils are connected back-to-back to operate in the braking mode for said free moving regenerator-displacer such that said conditioned signal to said power switching circuit synchronizes the electrical current flow through said first and second solenoid coils for intermittently holding said regenerator-displacer to provide in-phase operation so that when said free moving regenerator-displacer has been moved to said ambient end by differential pressures caused by the maximum pressure portion of said alternating pressure wave from said compressor across said effective pneumatic piston cross-section area electrical current is switched through said first solenoid coil by said synchronizing means and holds said regenerator-displacer at said ambient temperature end until the minimum portion of said pressure wave from said compressor means is being approached whereupon the electrical current through said first solenoid coil is discontinued allowing said regenerator-displacer to move in a quick motion back to said cold end and electrical current is switched through said second solenoid coil by said synchronizing means and holds said regenerator-displacer at said cold end until the maximum portion of said alternating pressure wave is being approached whereupon the electrical current through said second solenoid coil is discontinued allowing said regenerator-displacer to move in a quick motion back to said ambient end resulting in more work done according to the said cryogenic cooler and more refrigeration at said cold end.

* * * * *